US012446652B2

(12) United States Patent
Soin

(10) Patent No.: US 12,446,652 B2
(45) Date of Patent: Oct. 21, 2025

(54) CUSTOMIZABLE DETACHABLE SHOE

(71) Applicant: Vatsal Soin, Kanpur (IN)

(72) Inventor: Vatsal Soin, Kanpur (IN)

( * ) Notice: Subject to any disclaimer, the term of this patent is extended or adjusted under 35 U.S.C. 154(b) by 0 days.

(21) Appl. No.: 18/713,669

(22) PCT Filed: May 17, 2022

(86) PCT No.: PCT/IB2022/054556
§ 371 (c)(1),
(2) Date: May 27, 2024

(87) PCT Pub. No.: WO2023/187457
PCT Pub. Date: Oct. 5, 2023

(65) Prior Publication Data

US 2025/0017311 A1 Jan. 16, 2025

(30) Foreign Application Priority Data

Mar. 31, 2022 (IN) ..... 202211019418

(51) Int. Cl.
*A43B 3/24* (2006.01)

(52) U.S. Cl.
CPC ..... *A43B 3/246* (2013.01); *A43B 3/244* (2013.01)

(58) Field of Classification Search
CPC ..... A43B 3/242; A43B 3/244; A43B 3/246; A43B 3/26; A43B 7/38; A43B 13/36
USPC ..... 36/100, 101, 15
See application file for complete search history.

(56) References Cited

U.S. PATENT DOCUMENTS

| | | | | |
|---|---|---|---|---|
| 4,281,466 | A * | 8/1981 | Malone | A43B 5/18 36/130 |
| 2006/0201034 | A1* | 9/2006 | Ambrogio | A43B 3/244 36/101 |
| 2014/0013622 | A1* | 1/2014 | Borroto | A43B 3/244 36/100 |
| 2016/0242493 | A1* | 8/2016 | Stillwagon | A43C 5/00 |
| 2017/0231316 | A1* | 8/2017 | Sethi | A43B 13/36 36/97 |
| 2021/0145112 | A1* | 5/2021 | Maddox | A43B 13/125 |

* cited by examiner

*Primary Examiner* — Ted Kavanaugh

(57) ABSTRACT

The present disclosure explains adetachable and customizable shoe. The shoe includes a sole (101), an upper body (103) and a detachable strip (201). The sole (101) is detachably engaged with a first periphery of the detachable strip (201) by a zipper means and the upper body (103) is detachably engaged with a second periphery of the detachable strip (201) by a zipper means. The detachable strip (201) is provided for customizing parameters of the shoe including height and width. The engagement and disengagement of the sole (101) and the upper body (103) with the detachable strip (201) forms the detachable shoe, wherein the detachable strip (201) imparts customization of the shoe based on requirement of the wearer.

9 Claims, 5 Drawing Sheets

CUSTOMIZABLE DETACHABLE SHOE

FIELD

The embodiments herein generally relates to footwear. More particularly, the disclosure relates to detachable and customizable footwear.

BACKGROUND AND PRIOR ART

Footwear is integral in protecting feetduring walking and running. There are various types of footwear based on nature of use and application such as boots, sandals, shoes, heels and many more. A persons spends a majority of time in footwear, thus a set of comfortable footwear assists in betterment of health, provides support and stability to the feet.

Presently, footwear is provided in various shapes, sizes and forms for accommodating feet of the wearer. However, the size and shape is fixed for a given set of shoe based on the sole. Further, there are recentdevelopments in the footwear industry wherein the sole of the footwear is detachable from the upper body and vice versa. The sole is detachably attached to the upper body of the shoe through means of a zipper. Detachable attachment of the upper body with the sole of the footwear provides ease of cleaning, interchangeability and improves durability.

However, it is necessary for footwear to provide perfect fit to the feet of the wearer. Incorrectly fitted footwear is a cause for foot pain and numerous disorders in the feet. The existing range of detachable footwear specifically targets the capability of detaching the upper body from the sole and vice versa.

Therefore, there is a need for footwear providing customization in shape and size for enhancing comfort and user experience. Moreover, there is a need for a detachable shoe capable of being modified for accommodating various sizes and shapes of feet to provide custom fit to the wearer.

OBJECTS

Some of the objects of the present disclosure are described herein below:

The main objective of the present disclosure is to provide detachable footwear.

Another objective of the present disclosure is to provide detachable footwear providing customization is shape and size.

Still another objective of the present disclosure is to provide detachable footwear improving comfort and fit based on user requirement.

Yet another objective of the present disclosure is to provide detachable footwear having a zipper means for interchangeability and customization based on the wearer.

The other objectives and advantages of the present disclosure will be apparent from the following description when read in conjunction with the accompanying drawings, which are incorporated for illustration of preferred embodiments of the present disclosure and are not intended to limit the scope thereof.

SUMMARY

In view of the foregoing, an embodiment herein provides detachable and customizable shoe.

In accordance with an embodiment, the customizable detachable means of footwear, comprises a sole, an upper body removably attached with the sole, wherein the sole includes an upper edge and a lower edge and the upper body includes a lower edge. A toothed layer is fixed to the lower edge of the upper body and a toothed layer is fixed to the upper edge of the sole. A detachable strip including a first periphery and a second periphery is provided for engaging with the sole and the upper body for customizing height and width of the footwear. A toothed layer is fixed to the first periphery and a toothed layer is fixed to the second periphery of the detachable strip. The toothed layer on the first periphery engages with the toothed layer on the upper edge of the sole and the toothed layer on the second periphery engages with the toothed layer on the lower edge of the upper body. A zipper means engages the toothed layer on the upper edge of the sole with the first periphery forming a first engagement portion and a zipper means engages the toothed layer on the lower edge of the upper body with the second periphery forming a second engagement portion.

In accordance with an embodiment, wherein the first engagement portion is provided rigid for supporting lower part of foot of a wearer and the second engagement portion is provided stretchable for imparting fit to the foot of the wearer.

In accordance with an embodiment, the detachable strip provides height adjustment and width adjustment for varying height and width of the footwear based on size of foot of a wearer. In an embodiment, the detachable strip facilitates interchangeability with detachable strips of varied height for varying the height of the footwear. In an embodiment, the detachable strip facilitates interchangeability with detachable strips of varied thickness for varying width of the footwear. In an embodiment, the upper body of the shoe facilitates interchangeability with upper body of varied thickness for varying thickness of the footwear based on size of foot of a wearer.

In accordance with an embodiment, material of the thickness of the detachable strip and the upper body includes one or a combination of woolen, fur, cotton, waterproof material, and dustproof material.

In accordance with an embodiment, length of the toothed layer on the lower edge of the upper body is dependent on interchangeability with upper body of footwear of a category including heels, sandals, slippers, flip flops and shoes.

In an embodiment, the upper body includes a first vamp, second vamp, quarter, eyelets, tongue, 'U' binding, collar and counter.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION OF THE PREFERRED EMBODIMENTS

Figure 1:
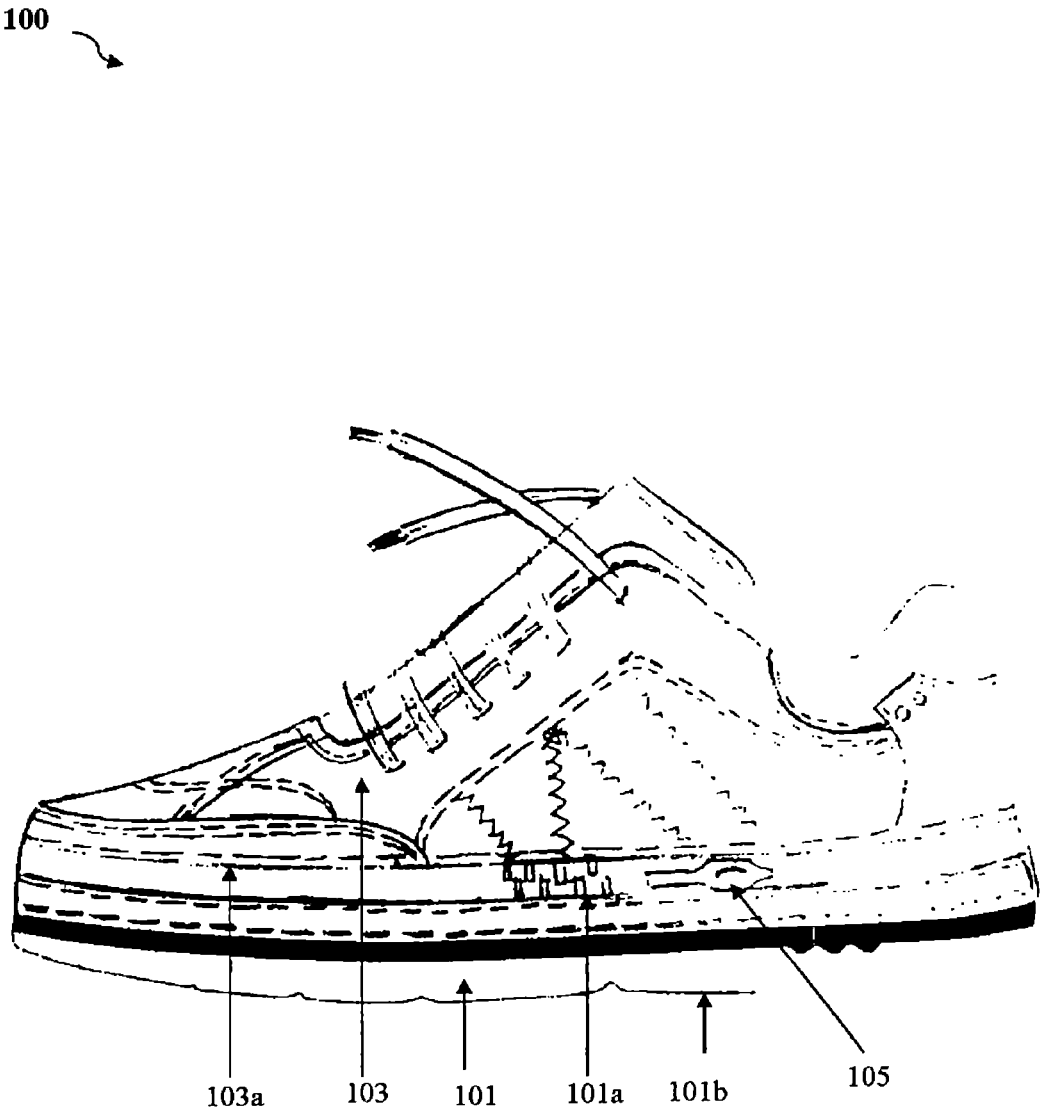
FIG. 1 illustrates a detachable shoe, according to an embodiment herein.

The embodiments herein and the various features and advantageous details thereof are explained more fully with reference to the non-limiting embodiments and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned above, there is a need for improvement in detachable footwear for providing customization in shape and size for enhancing comfort and user experience. In particular, there is a need for a detachable shoe capable of being modified for accommodating various sizes and shapes of feet to provide custom fit to the wearer. The embodiments herein achieve this by providing "A Customizable Detachable Shoe". Referring now to the drawings and more particularly to FIG. 1 to FIG. 5*d*, where similar reference characters denote corresponding features consistently throughout the figures, there are shown preferred embodiments.

FIG. 1 illustrates a detachable shoe, according to an embodiment. In an embodiment, the shoe includes a sole 101 and an upper body 103. The sole 101 includes an upper edge 101*a* and a lower edge 101*b*. A toothed layer is provided on the upper edge 101*a*. The upper body 103 includes a lower edge 103*a*. A toothed layer is provided on the lower edge 103*a*. A zipper means 105 is provided on the toothed layer on the lower edge 103*a* for engaging with the toothed layer provided on the upper edge 101*a* of the sole. The engagement of the toothed layer on the upper edge 101*a* with the toothed layer on the lower edge 103*a* by the zipper means 105 attaches the sole 101 to the upper body 103 of the shoe. The disengagement of the toothed layer on the upper edge 101*a* with the toothed layer on the lower edge 103*a* by the zipper means 105 detaches the sole 101 from the upper body 103.

Figure 2:
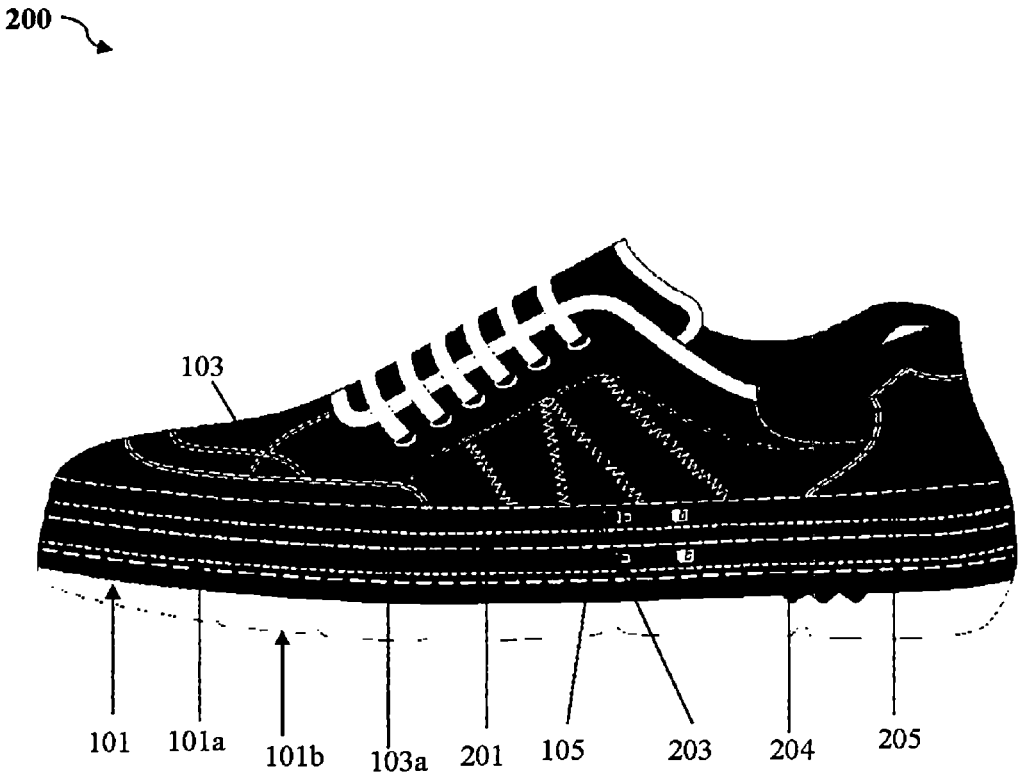
FIG. 2 illustrates a schematic of a customizable detachable shoe, according to an embodiment herein.

FIG. 2 illustrates a schematic of a customizable detachable shoe, according to an embodiment. The detachable shoe includes the sole 101, the upper body 103 and a detachable strip 201.

The sole 101 includes the upper edge 101*a* and the lower edge 101*b*. The toothed layer is provided on a periphery of the upper edge 101*a* of the sole. In an embodiment, a means of fixing the toothed layer to the upper edge 101*a* including but not limited to stitching. The detachable strip 201 includes a first periphery and a second periphery. The first periphery of the detachable strip 201 includes a toothed layer with a zipper means 203 and the second periphery of the detachable strip 201 includes a toothed layer.

In an embodiment, the toothed layer on the upper edge 101*a* of the sole 101 is engaged with the first periphery of the detachable strip 201 by the zipper means 203 forming a first engagement portion 204. The toothed layer on the lower edge 103*a* of the upper body 103 is engaged with the toothed layer on the second periphery of the detachable strip 201 by the zipper means 105 forming a second engagement portion 205.

In an embodiment, the first engagement portion 204 and the second engagement portion 205 varying in material and size. Material of the first engagement portion 204 including the toothed layer on the upper edge 101*a* and the toothed layer on the first periphery of the detachable strip 201 being hard and solid for supporting lower part of foot. Material of the second engagement portion including the toothed layer on the lower edge 103*a* and the toothed layer on the second periphery of the detachable strip 201 being soft and stretchable for sustaining shape and imparting comfort and fitting to the foot of the wearer.

In an embodiment, the engagement of the detachable strip 201 with the sole 101 and the upper body 103 increases a height of the shoe for providing custom fit to the wearer.

In an embodiment, a means of fixing the toothed layer to the first periphery and the second periphery of the detachable strip 201 including but not limited to stitching.

Figure 3A:
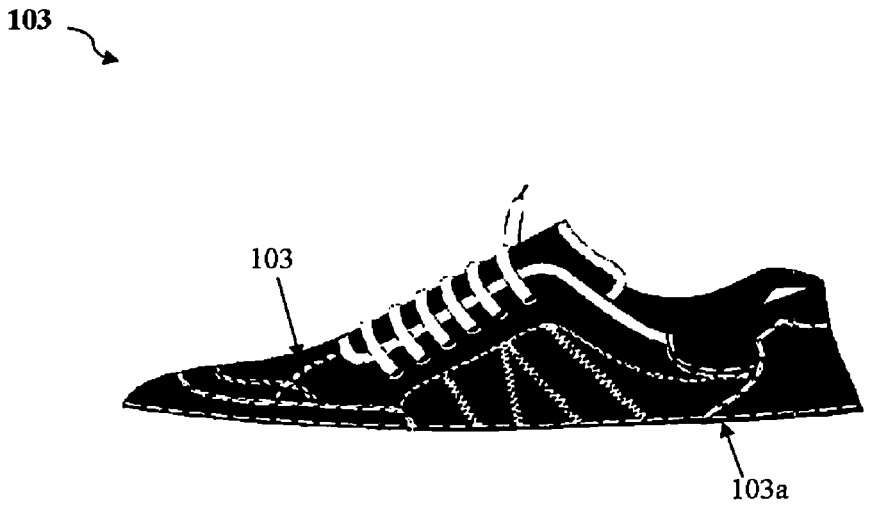
FIG. 3*a* illustrates a schematic of an upper body of the customizable detachable shoe, according to an embodiment herein.

FIG. 3*a* illustrates a schematic of an upper body of the customizable detachable shoe. The upper body 103 including the lower edge 103*a* is detachable from the sole.

In an embodiment, the upper body interchangeable with upper body of footwear including but not limited to sandal, flip flop. In an embodiment, the sole interchangeable with soles of footwear including but not limited to heels, shoes, dance shoes, sports shoes.

Figure 3B:
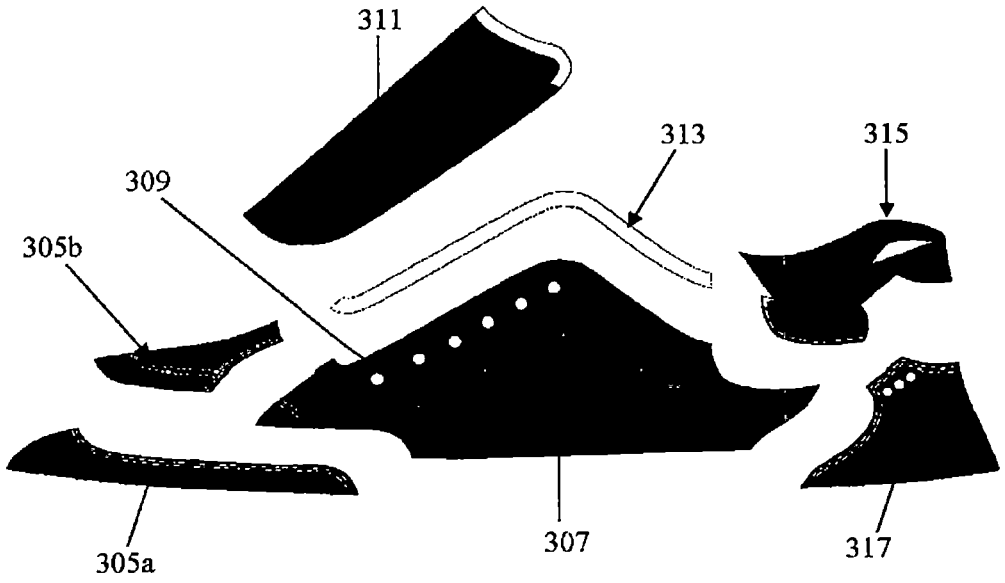
FIG. 3*b* illustrates an exploded view of parts of the upper body of the customizable detachable shoe, according to an embodiment herein.

FIG. 3*b* illustrates an exploded view of parts of the upper body of the customizable detachable shoe. In an embodiment, the upper body 103 includes but not limited to first vamp 305*a*, second vamp 305*b*, quarter 307, eyelets 309 for lace, tongue 311, 'U' binding 313, collar 315 and counter 317.

Figure 4:
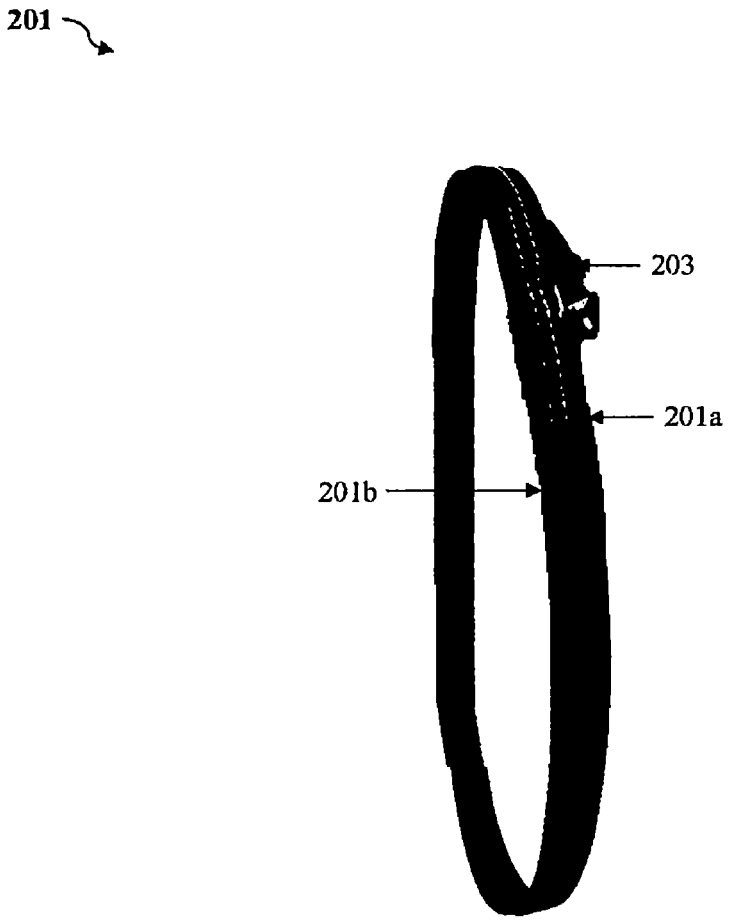
FIG. 4 illustrates the detachable strip of the customizable detachable shoe, according to an embodiment herein.

FIG. 4 illustrates the detachable strip of the customizable detachable shoe. In an embodiment, the detachable strip 201 includes the first periphery 201*a* and the second periphery 201*b*. The first periphery 201*a* includes the toothed layer for engaging with the toothed layer provided on the upper end 101*a* of the sole. The second periphery 201*b* includes the toothed layer for engaging with the toothed layer provided 101 on the lower edge 103*a* of the upper body 103.

In an embodiment, length of the toothed layer on the second periphery 201*b* of the detachable strip based on upper body 103 for forming a type of footwear. The footwear including but not limited to heels, flip flops, sandals, boots, sport shoes, dance shoes. The non-toothed surface on the second periphery 201*b* is provided plain. In an embodiment, the toothed layer on the second periphery 201*b* of the detachable strip transforms one class/category of footwear into another class/category of footwear based on the upper body 103 engaged with the second periphery 201*b* of the detachable strip 201.

In an embodiment, the first periphery 201*a* and the second periphery 201*b* including various colors. The detachable strip 201 varying in material thickness, design, colors and features. In an embodiment, the detachable strip 201 facilitates customizing size and fit of the shoe based on the wearer. The detachable strip 201 adjusts size of the shoes based on the sides/arch (left, right) of the foot and upper (bridge) part of the foot.

In an embodiment, the detachable strip 201 includes a height adjustment detachable strip and a width adjustment detachable strip. The height adjustment detachable strip 201 varies total height of the shoe based on fit and comfort of the user. The width adjustment detachable strip varies width of the shoe based on fit comfort and size of sides/arch (left, right) of the foot and upper (bridge) part of the foot.

In an embodiment, the detachable strip 201 for improving fit due to shrinkage issues of shoes which occur due to weather, material, wear and tear and so on. In an embodiment, parameters of the detachable strip 201 including but not limited to eco-friendly material, transparency, breathability of material, colors, fluorescence, specifications based on type of sports, medical requirement and orthopedic requirement. In another embodiment, a hidden toothed layer with a zipper means is attached to the upper body 103, whereby a lace shoe transformed into a loafer for providing extra stretch to the bridge (upper part of the foot).

In an embodiment, the detachable strip 201 including padding with variable height width and thickness for varying size and comfort of the shoe based on the foot of the wearer. In another embodiment, the upper body 103 of the shoe including padding with variable height width and thickness for varying size and comfort of the shoe based on the foot of the wearer. In an embodiment, material of the padding of the detachable strip 201 and the upper body 103 including but not limited to woolen/fur coated lining for winter, cotton lining for summer, waterproof lining for rainy season, dustproof for windy season and other specific requirements.

Figure 5A:
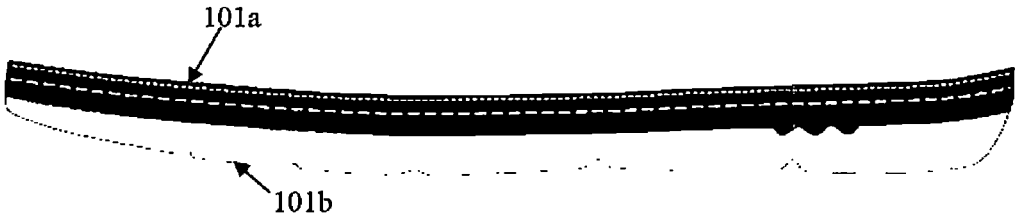
FIG. 5*a* illustrates the sole of the customizable detachable shoe, according to an embodiment herein.

FIG. 5*a* illustrates the sole of the customizable detachable shoe. In an embodiment, the sole includes the upper edge 101*a* and the lower edge 101*b*. The upper edge 101*a* includes the toothed layer for engaging with another toothed layer.

Figure 5B:
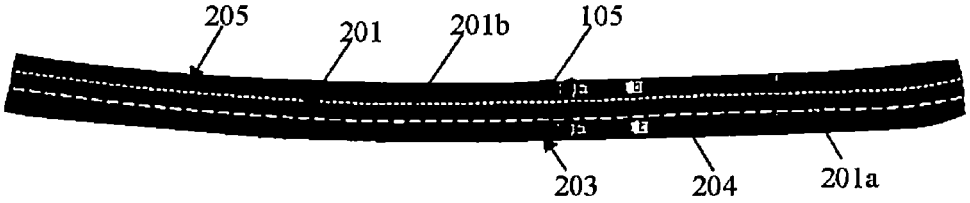
FIG. 5*b* illustrates the detachable strip with the engagement portions, according to an embodiment herein.

FIG. 5*b* illustrates the detachable strip with the engagement portions. The detachable strip 201 includes the first engagement portion 204 formed by the zipper means 203 and the second engagement portion 205 formed by the zipper means 105.

Figure 5C:
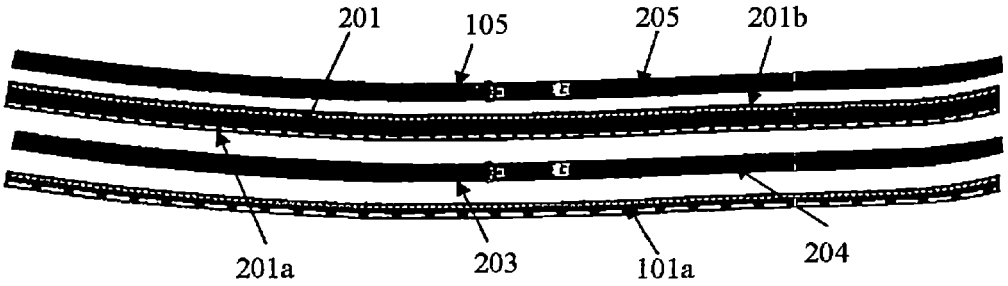
FIG. 5*c* illustrates an exploded view of the detachable strip with the engagement portions, according to an embodiment herein.

FIG. 5*c* illustrates an exploded view of the detachable strip with the engagement portions. The detachable strip 201 includes toothed layers at the first periphery 201*a* and the second periphery 201*b*. The toothed layer at the first periphery 201*a* forms the first engagement portion 204 with another toothed layer through the zipper means 203. The toothed layer at the second periphery 201*b* forms the second engagement portion 205 with the toothed layer of the upper edge 101*a* of the sole through the zipper means 105.

Figure 5D:
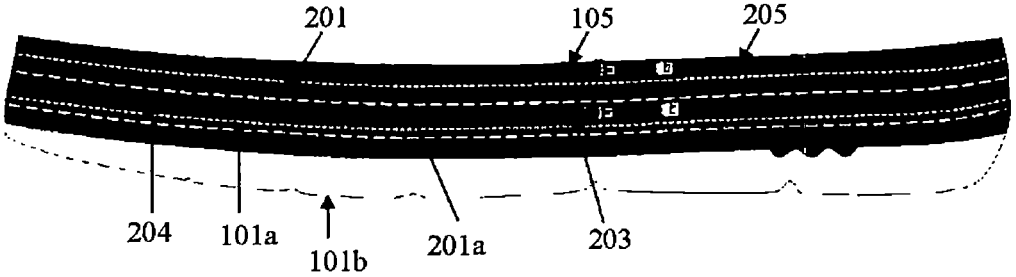
FIG. 5*d* illustrates the detachable strip engaged with the sole of the customizable detachable shoe.

FIG. 5*d* illustrates the detachable strip engaged with the sole of the customizable detachable shoe. In an embodiment, the toothed layer at the upper edge 101*a* of the sole 101 is engaged with the toothed layer provided on the first periphery 201*a* of the detachable strip thereby enabling attachment and detachment of the sole.

A main advantage of the present disclosure is that the customizable detachable footwear imparts customization.

Another advantage of the present disclosure is that the customizable detachable footwear provides a detachable strip for height and width customization for the wearer.

Yet another advantage of the present disclosure is that the customizable detachable footwear helps in drastically minimize aftersale problems/issues/complaints such as returns, replacements, repairs/rejections and thereby reducing courier/transport and sales costs.

Still another advantage of the present disclosure is that customizable detachable footwear provides economical and cost effective customization of size of footwear.

Yet another advantage of the present disclosure is that the customizable detachable footwear provides large scale interchangeability for producing various kinds of footwear in various shapes, sizes and fits based on the wearer.

Another advantage of the present disclosure is that the customizable detachable footwear facilitates independent production and marketing of upper body, sole and detachable strip of the shoe.

Yet another advantage of the present disclosure is that the customizable detachable shoe facilitates re-modeling, refurbishing, redesigning, repairing of finished shoes thereby preventing accumulation of large inventories of non-moving finished goods in multiple levels i.e., manufacturer, distributor, retailer, showroom and warehouse.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein

I claim:

1. A footwear comprising:

a sole (101) including an upper edge (101*a*) and a lower edge (101*b*);

an upper body (103) including a lower edge (103*a*), the upper body (103) being removably attached with the sole (101);

a toothed layer fixed to the lower edge (103*a*) of the upper body (103);

a toothed layer fixed to the upper edge (101*a*) of the sole (101);

a detachable strip (201) including:

a first periphery (201*a*) having a toothed layer fixed thereto;

a second periphery (201*b*) having a toothed layer fixed thereto;

wherein the toothed layer on the first periphery (201*a*) and the toothed layer on the upper edge (101*a*) of the sole (101) are configured to be engaged via a zipper means (203) to form a first engagement portion (204);

wherein the toothed layer on the second periphery (201*b*) and the toothed layer on the lower edge (103*a*) of the upper body (103) are configured to be engaged via a zipper means (205) to form a second engagement portion (205); and wherein the detachable strip (201) is configured and engages with the sole (101) and the upper body (103) to customize a height of the footwear.

2. The footwear as claimed in claim 1, wherein the first engagement portion (204) is rigid and configured to support lower part of a wearer's foot, and the second engagement portion (205) is stretchable and configured to secure fit to the wearer's foot.

3. The footwear as claimed in claim 1, wherein the detachable strip (201) has a height configured to vary the overall height of the footwear based on the size of a wearer's foot to improve fit and comfort.

4. The footwear as claimed in claim 1, wherein the detachable strip (201) is configured to allow interchangeability with detachable strips of varied height to adjust the height of the footwear.

5. The footwear as claimed in claim 1, wherein the detachable strip (201) is configured to allow interchangeability with detachable strips of varied thickness to improve fit and comfort of the footwear.

6. The footwear as claimed in claim 1, wherein the upper body (103) is configured to allow interchangeability with upper bodies having varied thickness to improve fit and comfort of the footwear based on foot profile.

7. The footwear as claimed in claim 6, wherein the material of the detachable strip (201) and the upper body (103) includes one or a combination of woolen, fur, cotton, and waterproof materials.

8. The footwear as claimed in claim 1, wherein the toothed layer on the lower edge (103*a*) of the upper body (103) is configured to enable engagement with interchangeable upper bodies of varying types.

9. The footwear as claimed in claim 1, wherein the upper body (103) includes a first vamp (305*a*), a second vamp (305*b*), a quarter (307), eyelets (309), a tongue (311), a U-shaped binding (313), a collar (315), and a counter (317).

* * * * *